United States Patent [19]

Stein et al.

[11] Patent Number: 4,955,106

[45] Date of Patent: Sep. 11, 1990

[54] UPRIGHT VACUUM CLEANER

[75] Inventors: Klaus Stein; Heinz Kaulig, both of Velbert, Fed. Rep. of Germany

[73] Assignee: Stein & Co. GmbH, Velbert, Fed. Rep. of Germany

[21] Appl. No.: 466,032

[22] Filed: Jan. 17, 1990

[30] Foreign Application Priority Data

Mar. 22, 1989 [DE] Fed. Rep. of Germany ..... 3909408

[51] Int. Cl.[5] ..... A47L 5/32

[52] U.S. Cl. ..... 15/335; 15/323; 15/339; 15/410

[58] Field of Search ..... 15/331, 334, 335, 350, 15/351

[56] References Cited

U.S. PATENT DOCUMENTS

| | | | |
|---|---|---|---|
| 2,210,950 | 8/1940 | Replogle | 15/335 X |
| 2,343,056 | 2/1944 | Harlett | 15/328 X |
| 2,867,833 | 1/1959 | Duff | 15/410 X |
| 2,898,621 | 8/1959 | Vance | 15/334 X |
| 2,898,622 | 8/1959 | Hurd | 15/334 X |
| 3,879,797 | 4/1975 | Principe et al. | 15/334 |
| 4,171,553 | 10/1979 | Stein | 15/335 X |
| 4,376,322 | 3/1983 | Lockhart et al. | 15/334 X |
| 4,573,236 | 3/1986 | Dyson | 15/334 X |
| 4,686,736 | 8/1987 | Petralia et al. | 15/332 |
| 4,761,850 | 8/1988 | Romeo et al. | 15/323 |

FOREIGN PATENT DOCUMENTS

| | | | |
|---|---|---|---|
| 3543376 | 6/1987 | Fed. Rep. of Germany | 15/335 |

*Primary Examiner*—Chris K. Moore

*Attorney, Agent, or Firm*—Thomas N. Ljungman

[57] ABSTRACT

This invention relates to upright vacuum cleaners which have a detachable hand-held vacuum hose as an ascending line. The hand-held vacuum hose is coupled to a hand-held vacuum tube which serves as an extension. The hand-held vacuum tube is thereby designed as a storage housing for the telescoping hand-held vacuum hose.

9 Claims, 10 Drawing Sheets

UPRIGHT VACUUM CLEANER

BACKGROUND OF THE INVENTION

1. Field of the Invention

This invention relates to an upright vacuum cleaner, in particular a brush-type vacuum cleaner, whereby air laden with dirt is transported from a vacuum nozzle located in the vicinity of the floor via a hand-held vacuum hose as an ascending line into a filter in the upper region of the housing. The hand-held vacuum hose is detachably located in the portion facing the vacuum nozzle for auxiliary vacuuming operations.

2. Description of the Prior Art

The prior art includes devices of this type to facilitate auxiliary vacuuming operations. One problem, however, is that the hand-held vacuum hoses are relatively short, and the user has to bend over to vacuum corners etc. The prior art also provides extensions for this purpose.

In practice, however, this arrangement is considered somewhat awkward and inconvenient to use, and is therefore often not used.

The prior art also includes devices which incorporate a hand-held vacuum tube and a hand-held vacuum hose, between the hand-held vacuum tube and the filter, which are long enough to allow unimpeded operation of the machine. In such a device, however, one disadvantage is that the hand-held vacuum hose can no longer be easily attached to the machine, and thus creates interference when the machine is used for normal floor vacuuming operation. In this type of operation, moreover, the distance the working air has to travel is increased, which means that increased vacuum losses occur.

OBJECT OF THE INVENTION

The object of the invention is to improve a generic device of this type, to make possible multi-faceted configurations for all operating applications with relatively low vacuum losses, and to provide a greater reach and range of auxiliary operations, without interfering with normal floor vacuuming operation.

SUMMARY OF THE INVENTION

This object is accomplished by the invention in that the hand-held vacuum hose is coupled to a hand-held vacuum tube, which serves as an extension and is designed so that during floor vacuuming operation it serves as a storage site for the telescoping hand-held vacuum hose.

It thereby becomes possible to have a relatively long hand-held vacuum hose for the required large range of action, which remains out of the way during floor vacuuming and thereby keeps the distance travelled by the working air short. When the hand-held vacuum tube is inserted into the machine for floor vacuuming operations, the extended hand-held vacuum hose is sucked back in by the underpressure which is present in the hand-held vacuum tube.

In one favorable configuration of the invention, the terminal portion of the hand-held vacuum hose can be fixed in the extended position with the corresponding end of the hand-held vacuum tube by means of a catch.

For multi-purpose use, provision is made for the various accessories, in that the terminal portion of the hand-held vacuum hose is designed as a detachable vacuum mouthpiece.

To optimize suitably to the intended purpose, the invention proposes that the vacuum mouthpiece be designed to hold various working nozzles which can be of the slip-on type.

To give the machine a compact form, the invention proposes that the hand-held vacuum tube be located in a recess in the housing.

To facilitate handling for auxiliary vacuuming operations, the invention proposes that the hand-held vacuum tube be connected with a handle.

The objects of the invention are provided in a preferred embodiment including an upright vacuum cleaner for movement along a floor. The vacuum cleaner includes a housing having a blower for producing a suction therein. The housing has a lower end thereof with a floor suction component at the lower end. At the upper end of the housing remote from the lower end, there is included an operating handle. The floor suction: component includes wheels for movement along the floor. The floor suction component includes a rotating brush configuration for dislodging dirt and the like from the floor. A hose has a first end which is connected to the housing at the upper end thereof for transporting air to the blower of the housing. A removable tube is selectively mounted on the housing and has a first end for selective connection to the floor suction component when the tube is mounted on the housing. The removable tube has a second end at the upper end of the housing when the tube is mounted thereon. The hose has a substantial portion including a second end thereof which is remote from the first end for being received within the removable tube when the removable tube is selectively mounted on the housing.

BRIEF DESCRIPTION OF THE DRAWINGS

Various features of the invention are illustrated schematically in the accompanying drawings.

DESCRIPTION OF THE PREFERRED EMBODIMENT

Figure 1:
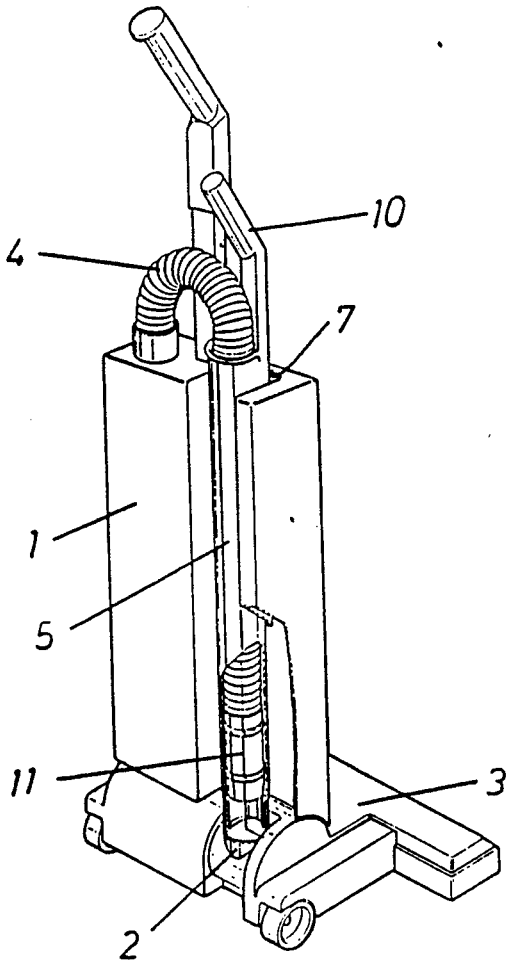
FIG. 1 shows an overall view of an upright brush-type vacuum cleaner for floor cleaning operations.
Figure 2:
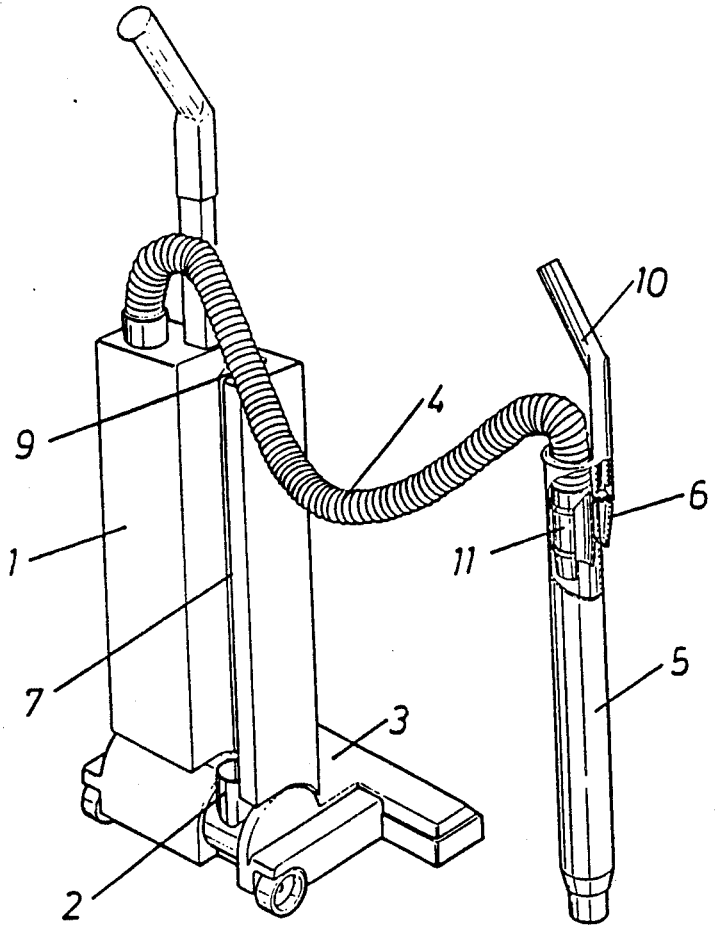
FIG. 2 shows a brush-type vacuum cleaner for auxiliary vacuuming operations with the hand-held vacuum tube.
Figure 3:
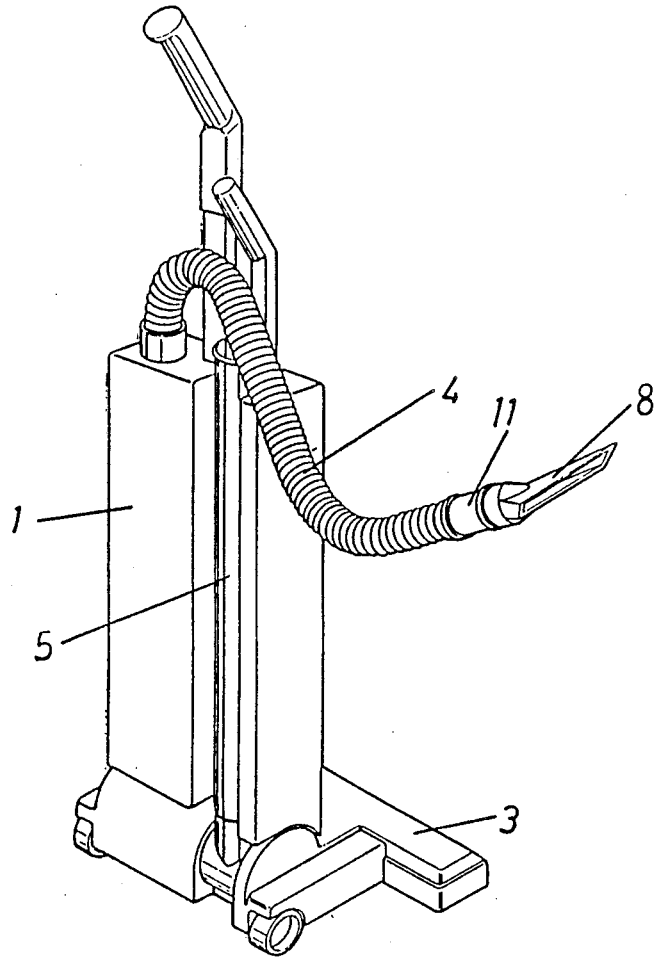
FIG. 3 shows an upright brush vacuum cleaner for auxiliary vacuuming operations with a hand-held vacuum hose, which is separated from the vacuum tube, with a working nozzle installed thereon.

The upright brush-type vacuum cleaner illustrated in FIGS. 1, 2 and 3 comprises a housing 1 with a handle which is designed as the filter cassette for a filter bag. In the lower portion there is a brush set 3 which is connected via a nozzle linkage 2 with a suction nozzle and can be rolled along the floor by means of corresponding wheels.

Connected to the upper portion of the housing 1 is the first end of a hand-held vacuum hose 4, which is supplied with working air by means of the suction nozzle. The hand-held vacuum hose 4 is detachably coupled with a hand-held vacuum tube 5. As best seen in FIG. 2, the end of the hand-held vacuum hose 4 with a vacuum mouthpiece 11 as a second end thereof connected via a detachable catch 6 with the corresponding end of the hand-held vacuum tube 5. As seen in FIG. 1, the hand-held vacuum tube 5 can be inserted in a recess 7 in the housing and is thereby connected at the lower end thereof with the nozzle linkage 2 leading to the vacuum nozzle. The hand-held vacuum tube 5 is thereby used as a storage site for the telescoping hand-held vacuum hose 4, located in the hand-held vacuum tube 5. The external portion of the hand-held vacuum hose 4 is thereby significantly shortened for normal floor vacuuming, which reduces vacuum losses and does not interfere with the operation of the machine. For floor vacuuming operation, in this position, a substantial portion of the hand-held vacuum hose 4 is disposed within the tube 5 and acts as an ascending line for the working air laden with dirt.

On the other hand, in the extended position of the hand-held vacuum hose 4 illustrated in FIG. 2, auxiliary vacuuming operations can be conducted over a large radius of action by means of the resulting extension of the hose 4 and the hand-held vacuum tube 5 which serves as a further extension. When the hand-held vacuum hose 4 is pulled out, it is fastened with its vacuum mouthpiece 11 on the end of the hand-held vacuum tube 5 by means of the catch 6 to prevent the hand-held vacuum tube 4, with its vacuum mouthpiece 11, from being sucked back in during operation. The catch 6 may be a pivoted member which is normally biased inwardly to extend into the interior of the tube 5 through an opening in the side wall thereof. The inward end of the catch can be notched or grooved to align with and engage raised portions on the mouthpiece 11 to prevent its insertion into or extraction from the tube 5.

For special auxiliary vacuuming operations, the vacuum mouthpiece 11 of the hand-held vacuum hose 4 is removed from the hand-held vacuum tube 5 by moving the catch 6 against the biasing to release the mouthpiece 11. As shown in FIG. 3, the vacuum tube 5 is replaced by appropriate slip-on operating nozzles 8.

With the mouthpiece inserted in the tube 5, the catch 6, when the hand-held vacuum tube 5 is inserted in the housing 1, is unlocked by an edge 9, and thus the manual vacuum hose 4 can be removed. The edge 9 can include a camming surface which acts on the lower end of the catch 6 to cause it to move outwardly against the biasing. To improve handling, the hand-held vacuum tube is extended by means of a handle 10.

After the auxiliary vacuuming operations have been completed, the vacuum mouthpiece 11 is inserted or screwed back into the hand-held vacuum tube 5, which is located in the recess 7 in the housing 1. Again, the edge 9 prevents the catch from engaging and entrapping the mouthpiece 11 at the outer end of the tube 5. When the fan motor is running, the hand-held vacuum hose 4 is automatically retracted by the underpressure in the hand-held vacuum tube 5, until the vacuum mouthpiece 11 assumes the position indicated in FIG. 1.

Figure 4:
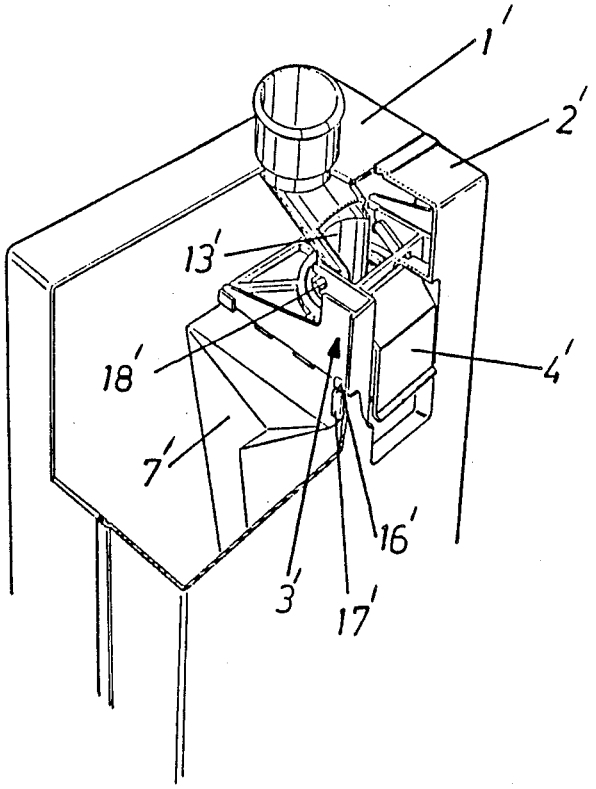
FIG. 4 shows the upper portion of a vacuum cleaner in the working position.
Figure 5:
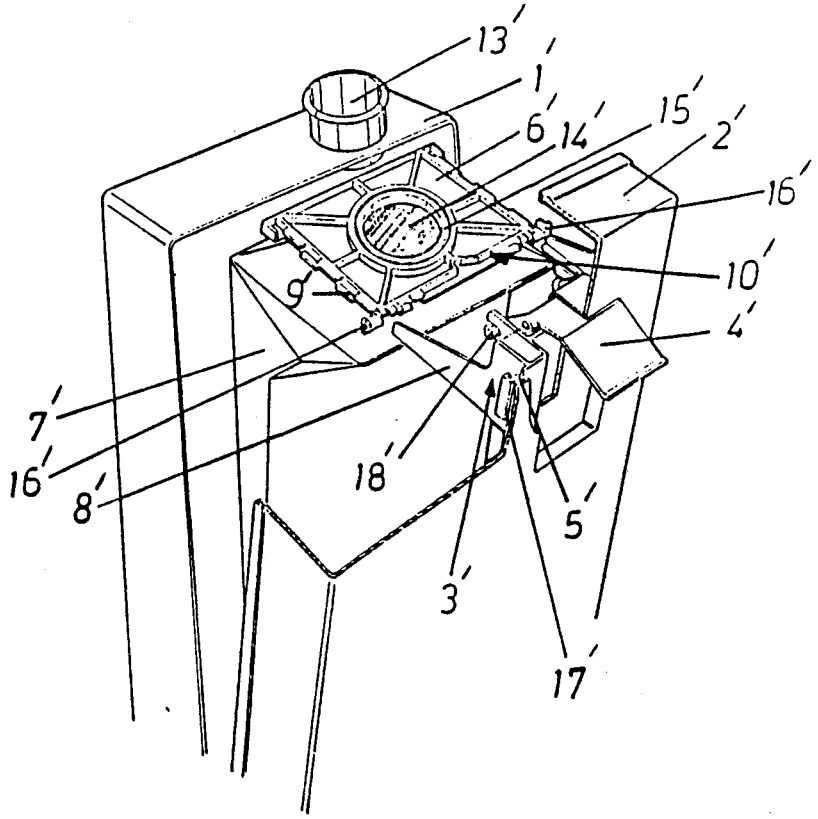
FIG. 5 is an illustration of the same portion, as in FIG. 4, in the position for replacing the filter bag.
Figure 6:
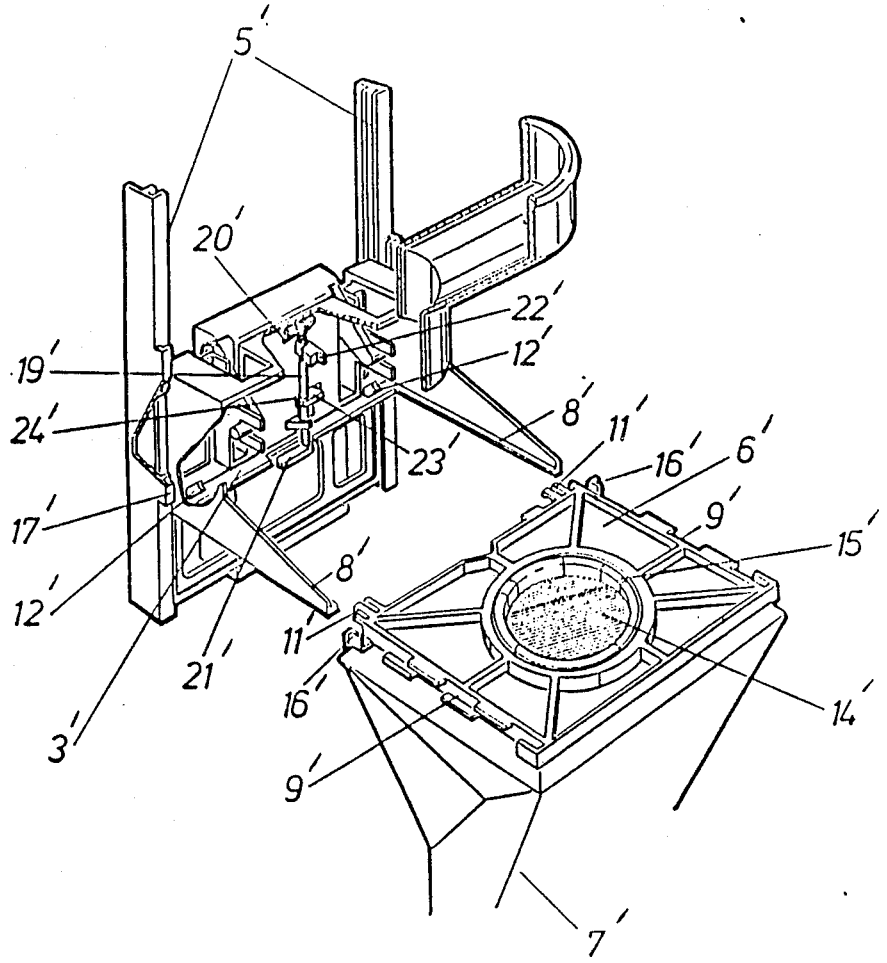
FIG. 6 is an enlarged view of the guide element with the corresponding reinforcement plate of the filter bag in the replacement position.
Figure 7:
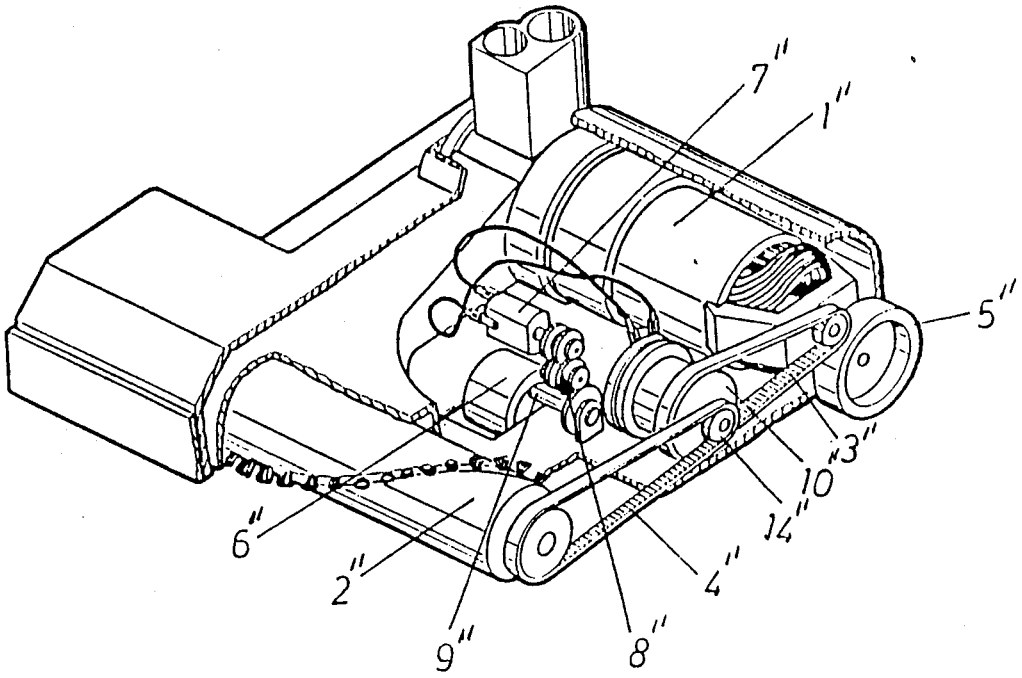
FIG. 7 shows a brush set in a perspective view.
Figure 8:
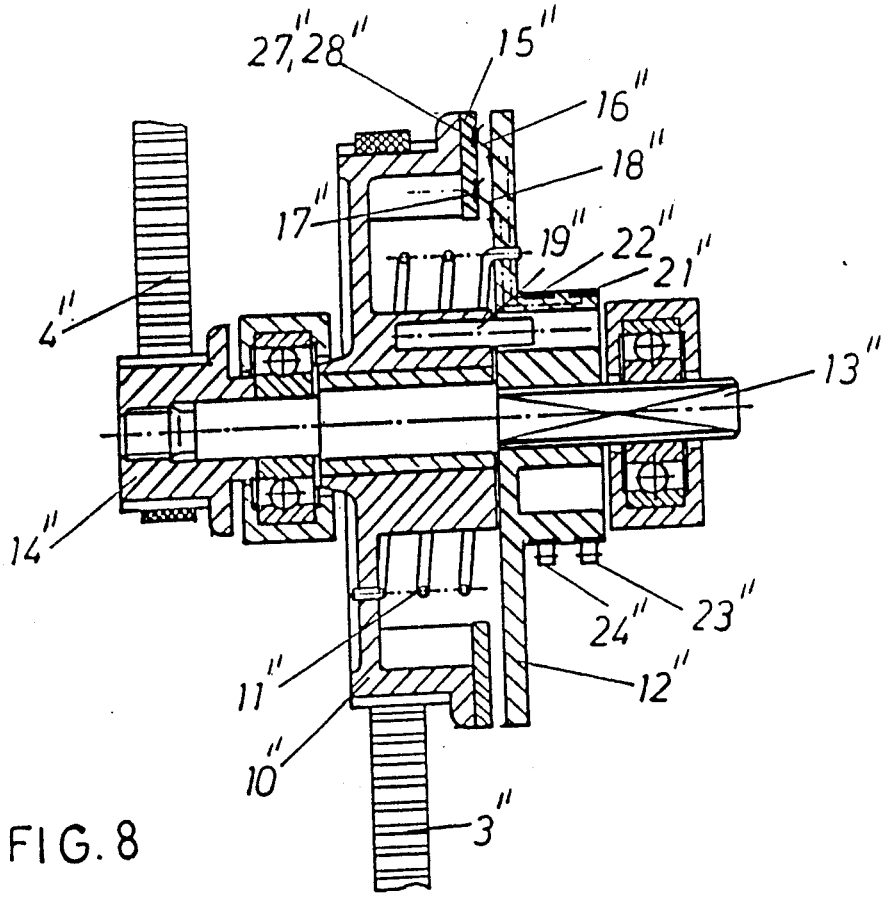
FIG. 8 shows a cross section of a torque measurement and comparison apparatus with a spring.
Figure 9:
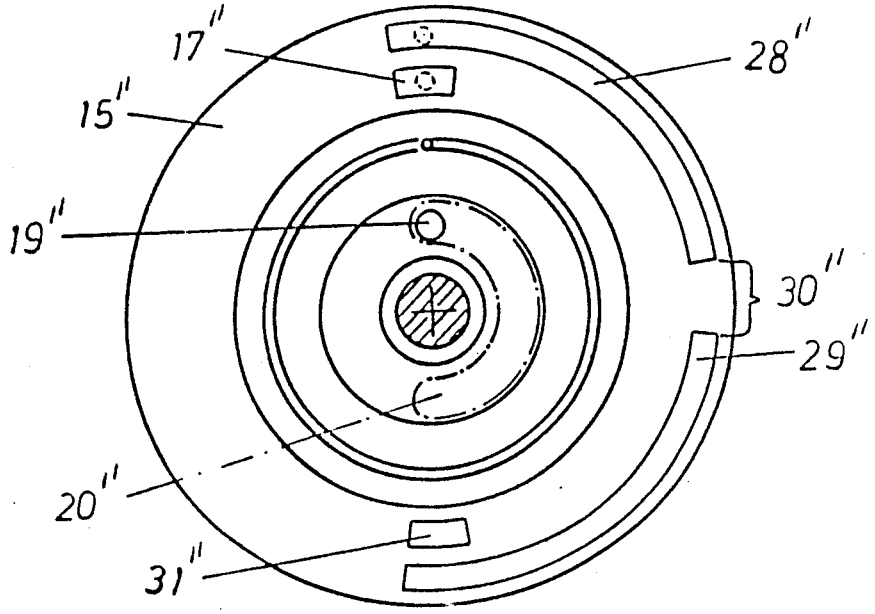
FIG. 9 shows a side view of a belt pulley, which is simultaneously designed as a cam disc with electrical contact rails.

As seen in FIGS. 4, 5 and 6, the illustrated arrangement comprises essentially a vacuum cleaner having a housing 1' with a removable cover 2', which can be inserted in the lower portion of the housing and is mounted so that it can be pivoted. Air is drawn into the housing 1' by a blower and motor at the bottom of the housing through connecting hose means and a fixed filter tube 13' to create a suction on a filter bag 7' mounted therein. In the cover 2', there is a vertically adjustable guide element 3', which can be displaced from its lower position (FIG. 5) into its upper position (FIG. 4) by means of an externally-operated control element 4' in the form of a mechanical lever. For this purpose, the guide element 3' is mounted so that it can move vertically by means of rails 5' in the cover 2'.

The guide element 3' also holds a reinforcement plate 6' of the filter bag 7' and, for that purpose, has mounting rails 8' for the lateral mounting of the reinforcement plate 6'. The reinforcement plate 6' has a corresponding mounting groove 9' which is discontinuous in places. This arrangement guarantees a fixed orientation between the reinforcement plate 6' and the guide element 3'. As best seen in FIGS. 5 and 6, on the inserted end 10' of the reinforcement plate 6', there are catches 11', corresponding to which there are recesses 12' in the guide element 3' for the corresponding mounting. As a result, the reinforcement plate 6' of the filter bag 7' is precisely positioned and held in the guide element 3' at an installed position.

To transport the dirt picked up by the vacuum cleaner a hose or other device (not shown) is connected to the fixed filler tube 13'. The fixed filter tube 13' is rigidly mounted in the housing 1', while the reinforcement plate 6' of the filter bag 7' has a filler opening 14' and a sealing lip 15'. The filler opening 14' of the reinforcement plate 6', after the correct insertion into the guide element 3', is thereby a direct extension of the filler tube 13'.

The reinforcement plate 6' also has lateral locking lugs 16', which, when installed in the guide element 3', have corresponding brackets 17' on the cover 2', and are engaged with one another when the guide element 3' is displaced upwardly.

As a result of the folding of the control element 4', when the cover 2' is installed and closed, a lever joint 18' displaces the guide element 3' in the rails 5' in the cover 2'. As a result, the inserted reinforcement plate 6' with its filler opening 14' and the sealing lip 15' are pushed over the filler tube 13' of the housing 1'.

To prevent the cover 2' from being closed when no filter bag 7' is installed at the installed position, and also to check on other functions, there is a control shaft 19' in the guide element 3', held by means of a return spring 20'. The control shaft has corresponding cams 21', 22' and 23'.

The following measures guarantee safe operation:

1. When the reinforcement plate 6' of the filter bag 7' is inserted into the guide element 3' to the installed position, a corresponding cam 21' is engaged by the inserted end 10' and rotates the control shaft 19' (to the position shown in FIG. 6) so that a cam 22' is positioned for closing of the cover 2'. Engagement of cam 21' to the position of FIG. 6 causes clock-wise rotating of the shaft 19' (when viewed from above) against the biasing of the return spring 20'. If the closing movement of the cover 2' is executed in the absence of the reinforcement plate 6' of the filter bag 7', or if the reinforcement plate 6' of the filter bag 7' is missing, the cam 22' impacts a corresponding aligned portion of the filler tube 13', such as a tab, fin or the like, to prevent rotation of the control shaft 19' to the position as shown in FIG. 6.

2. The control element 4' can only be adjusted if the filter bag 7' with the reinforcement plate 6' has been inserted, and the cover 2' is closed on the housing 1'. Otherwise, the cam 23' prevents the adjustment By inserting the reinforcement plate 6', the initial rotation of the control shaft 19' occurs, as seen in FIG. 6, but the cam 23' does not yet release the corresponding lock 24' and thus prevents the upward movement of the guide element 3' relative to the cover 2'.

Only when the cover 2' is installed on the housing 1' is a further rotation of the control shaft 19' (in a clockwise direction when viewed from above) performed by means of the cam 22' as it is cammed past the corresponding aligned portion of the filler tube 13'. Consequently, the cam 23' releases the corresponding lock 24' to allow the upward movement of the guide element 3'. Only then can the activator element 4' be adjusted, to raise the guide element 3' and push the reinforcement plate 6' with its filler opening 14' over the filler tube 13'.

3. The cover 2' is locked to the housing 1' by the upward movement of the guide element 3'. As a result of this movement, the locking lugs 16' located on the reinforcement plate 6' are pushed behind the brackets 17' located on the cover 2'. With the cover 2' rigidly connected with the reinforcement plate 6' and the reinforcement plate again engaged over the filler tube 13', the cover 2' is locked on the housing 1'.

The brush set as illustrated in FIGS. 7, 8, 9, 10 and 11 holds a fan motor 1", which simultaneously drives a brush roller 2" by means of toothed belts 3" and 4". The entire brush set is supported on the floor by means of two rear wheels 5" and one front wheel 6". The height of the wheel 6" can be adjusted, so that consequently the height of the brush roller 2" with its bristles can also be adjusted to the carpet pile to be cleaned. To adjust the wheel 6" there is a servomotor 7", which acts by means of a transmission 8" on the wheel 6". The wheel 6" is mounted by means of a cam 9", so that a large change in height can be effected by means of small actuator movements.

To make an adjustment to the floor to be cleaned, taking the carpet pile into consideration, the torque to be transmitted to the brush roller 2" is kept constant, and an adjustment of the wheel 6" is made accordingly.

For this purpose, the toothed belt 3", which is used as the drive, is guided over a belt pulley 10", and the drive power of the motor is transmitted with the interposition of a spring 11" tuned to the torque specified for the brush roller. The additional transmission of the drive movement takes place via a cam disc 12", which is attached by a keyed connection to a shaft 13". A belt pinion 14", which is mounted on the shaft 13", in turn drives the brush roller 2" via a belt 4". One end of the belt pulley 10" is designed as a cam disc 15" with electrical contact rails 28" and 29". The electrical contact rails 28" and 29" are used to generate an actuating signal to raise and lower the wheel 6", while an interrupted area 30" between the contact rails 28", 29" signals the correct adjustment of the wheel 6". For this purpose, the cam disc 15" has an associated cam disc 12", which supports a corresponding sliding contact 16" and is oriented in relation to the contact rails 28" and 29".

The cam disc 15" has an additional contact rail 31", which is oriented in relation to a sliding contact 18" of the cam disc 12". The contact rail 31" causes a disconnection of the fan motor 1" if the brush roller 2" is blocked. A bolt 19" on the belt pulley 10" is engaged in a groove 20" of the cam disc 12". The groove 20" is sized to correspond to the angle of rotation for the height adjustment.

If an overload is caused by a blocking of the brush roller 2" or excessive torque, the cam disc 12" rotates to the stop of the bolt 19", at which the sliding contact 18" is located on the contact rail 31", and the fan motor is shut off. The sliding contacts 6" and 18" are connected with corresponding sliding rails 21", 2". As a result, the signals are transmitted via corresponding contacts 23", 24", and are conducted as actuating signals to a control circuit.

The torque produced by the brushes can become increasingly smaller because of bristle wear, and a readjustment by retracting the wheel is no longer possible. When the wheel has reached its limit position, the sliding contact 18" reaches the sliding rail 17", and a signal is given to replace the brushes.

The spring 11" should be tuned to the torque to be transmitted for an optimal operation of the brush roller 2". The turning of the spring 11" should hold the cam discs 12", 15", in the presence of this torque, in an orientation so that the sliding contact 16" is in the area 30" between the contact rails 28" and 29".

When the cam discs 12", 15" are relatively rotating in the vicinity of the contact rail 28", the torque taken from the brush roller 2" is too low. Consequently, the brush roller 2" must be lowered, since it is not digging deeply enough into the carpet pile. In such a case, by means of the contact rail 28", the sliding contact 16", the sliding rail 21" and the contact 23", an actuating signal is generated for the servomotor 7" to retract the wheel 6" and thus lower the brush roller 2". This reaction will continue until the specified torque is reached, and the sliding contact 16" is once again in the area 30" between the contact rails 28" and 29".

When changing to a carpet with a longer pile, a higher torque necessarily occurs, since the brush roller 2" sinks deeper into the carpet. The corresponding cam discs 12", 15" are thereby rotated by means of the interposed spring 11" so that the sliding contact 16" is in the vicinity of the contact rail 29". As a result, corresponding actuating signal is generated for the servomotor 7" to extend the wheel 6", so that the brush roller 2" is raised and the specified torque is again reached.

In practice, the torque on the brush roller 2" can be sharply increased by foreign objects sucked in, such as scraps of paper and string. In such a case, the cam discs 12", 15", rotate opposite one another until the bolt 19" encounters the stop at the end of the groove 20", and the sliding contact 18" would be located on the sliding rail 31", whereupon the fan motor 1" would be disconnected.

So that the machine is not turned off when short-term changes in torque occur during operations, e.g. changes in the direction of movement, the preferred control system includes a delay circuit, to guarantee smooth operation.

Figure 10:
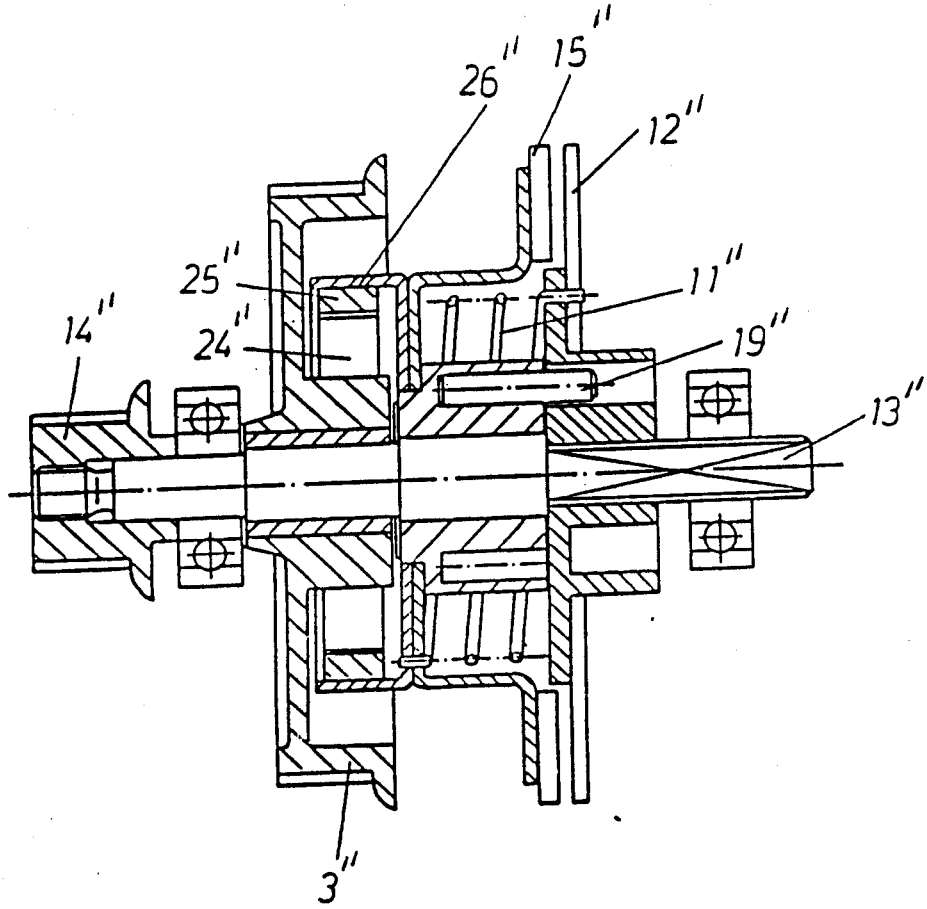
FIG. 10 shows an alternative embodiment of an adjustment apparatus with a slip coupling.

In the alternative embodiment illustrated in FIG. 10, a slip coupling is installed parallel to the spring 11". For this purpose, springs 24″ are connected to the belt pulley 10″ and have brake linings 25″. The brake linings 25″ transmit the torque to the brush roller 2″ through a corresponding brake drum 26″ associated with the cam disc 15″. The tension of the springs 24″ is thereby set to a maximum torque. When there is an extreme increase in the torque, or if the brush roller is blocked, the brake linings 25″ slide in the brake drum 26″, and no damage occurs to the drive system.

Figure 11:
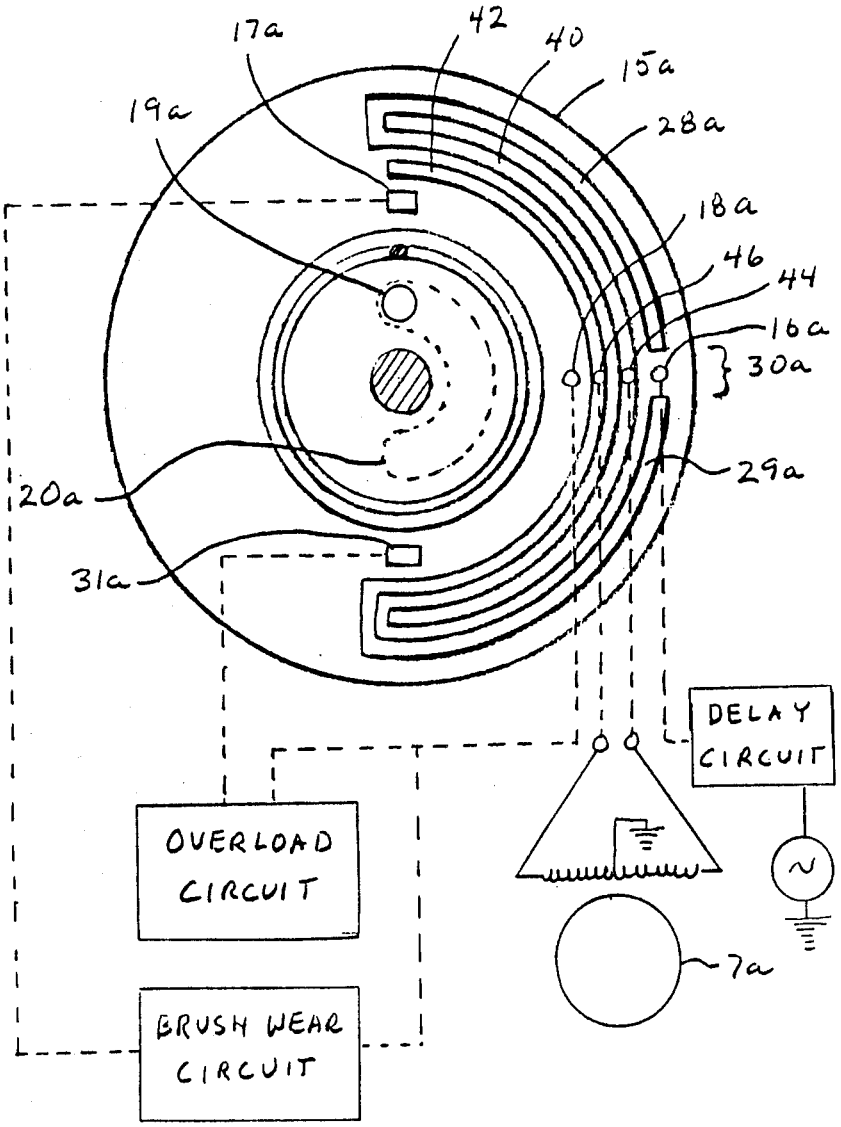
FIG. 11 shows a side view of a belt pulley including an alternative cam disc configuration and a schematic representation of other features of the invention.

As seen in FIG. 11, an alternative disc configuration includes contact rails **28*a* and 29*a* which are similar to contact rails 28″ and 29″ discussed hereinabove. Additionally, an interrupted area 30*a* provides the same function as did the interrupted area 30″ discussed above. For this configuration, the sliding contact 16*a* is again aligned with the contact rails 28*a* and 29*a* for operation of the servomotor represented by the rotor 7*a***.

In order to connect the contact rails **28*a* and 29*a* respectively to the windings of the servomotor of 7*a*, the contact rail 28*a* is electrically connected at the ends thereof to a semi-circular contact rail 40 while the contact rail 29*a* is electrically connected at the ends thereof to a semi-circular contact rail 42. With associated sliding contacts 44 and 46 respectively mounted on the other cam disc (not shown) in the same manner as the sliding contacts 16*a* and 18*a*, a current can be transferred through corresponding sliding rails on the other cam disc which are similar to sliding rails 21″, 22″ which are electronically connected to the sliding contacts 16″ and 18″ in the embodiment shown in FIG. 2. Consequently, current passing through the contact rails 40 and 42 and associated sliding contacts 44 and 46 are capable of providing appropriate current to the windings of the servomotor 7*a*** for either raising the height of the wheel or lowering the height of the wheel in the same manner as discussed hereinabove.

Additionally, as seen in FIG. 11, the sliding contacts **16*a*, 18*a*, 44 and 46 are shown in the position of preferred torque so that the contact 18*a* is not aligned with either of the contact rails 17*a* and 31*a* which are similar to the contact rails 17″ and 31″ as discussed hereinabove. Again, as discussed hereinabove, when sliding contact 18*a* is aligned with the contact rail 31*a* an overload condition will be transmitted to the overload circuitry for turning the fan motor off. In a similar manner, when the sliding contact 18*a* is aligned with the contact rail 17*a***, a signal will be transmitted to the brush wear circuitry to indicate that the brush roller should be replaced.

As also seen in FIG. 11, upon initial activation of the fan motor, the torque applied to the brush roller will not be in a stabilized condition. Accordingly, the power to the sliding contact 16″ can be temporarily interrupted by a delay circuit to allow stabilization of the torque prior to any indication of whether the wheel should be raised or lowered in response to the torque on the brush roller.

It should be clear that the alternative embodiment shown in FIG. 11 includes the various features of the invention as included in the embodiments discussed hereinabove but in a different form.

In summary, the invention includes an upright vacuum cleaner, in particular a brush-type vacuum cleaner, whereby air laden with dirt is transported from a vacuum nozzle located in the vicinity of the floor. The air passes through a hand-held vacuum hose, acting as an ascending hose, to a filter in an upper section of the housing. The portion of the hose facing the suction nozzle can be removed for auxiliary vacuuming operations. The invention is characterized by the fact that the hand-held suction hose 4 is coupled with a hand-held vacuum tube 5 serving as an extension. The tube 5 is designed so that during floor vacuuming operation it serves as a storage site for the telescoping hand-held vacuum hose 4. The terminal portion of the hand-held vacuum hose 4 can be fixed in the extended position with the corresponding end of the hand-held vacuum tube 5 by means of a catch 6. The terminal portion of the hand-held vacuum hose 4 is designed as a detachable vacuum mouthpiece 11. The vacuum mouthpiece 11 is designed to accept different slip-on working nozzles 8. The hand-held vacuum tube 5 is detachably located in a recess in the housing. The hand-held vacuum tube 5 is connected to a handle 10.

The invention as described hereinabove in the context of a preferred embodiment is not to be taken as limited to all of the provided details thereof, since modifications and variations thereof may be made without departing from the spirit and scope of the invention.

What is claimed is:

1. An upright vacuum cleaner for movement along a floor comprising:

a housing having suction producing means:

said housing having a lower end;

said housing having a floor suction component at said lower end thereof;

said housing having a upper end remote from said lower end;

said housing having an operating handle at said upper end;

said floor suction component having wheel means for movement of said housing along the floor;

said floor suction component including rotating brush means for dislodging dirt and the like from the floor;

a hose having a first end which is for being connected to said housing at said upper end thereof for transporting air to said suction producing means;

a removable tube for being selectively mounted on said housing;

said removable tube having a first end for selective connection to said floor suction component when said removable tube is mounted on said housing;

said removable tube having a second end which is disposed at said upper end of said housing when said removable tube is mounted thereon; and said hose having a substantial portion including a second end thereof which is remote from said first end for being received within said removable tube when said removable tube is mounted on said housing.

2. The upright vacuum cleaner according to claim 1, wherein said second end of said hose is for being selectively disposed at said second end of said removable tube with said substantial portion except for said second end of said hose being disposed outwardly of said removable tube.

3. The upright vacuum cleaner according to claim 2, wherein said removable tube is for being removable from said housing with said second end of said hose disposed at said second end of said removable tube for selective disposition of said first end of said removable tube for vacuuming.

4. The upright vacuum cleaner according to claim 3, wherein said removable tube includes additional handle means at said second end thereof.

5. The upright vacuum cleaner according to claim 2, wherein said removable tube includes catch means at said second end thereof and said catch means is for selectively securing said second end of said hose to said second end of said removable tube and releasing said second end of said hose for movement relative to said second end of said removable tube.

6. The upright vacuum cleaner according to claim 5, wherein said housing includes mating means at said upper end thereof for mating with said catch means when said removable tube is selectively mounted on said housing for causing said catch means to release said second end of said hose and said substantial portion including said second end thereof to be received within said removable tube.

7. The upright vacuum cleaner according to claim 1, wherein said second end of said hose is for being withdrawn from the said removable tube for selective disposition of said second end of said hose for vacuuming.

8. The upright vacuum cleaner according to claim 7, wherein said second end of said hose includes attachment means for attaching at least one of a plurality of hose attachments to said second end of said hose for selective disposition of said of least one of said plurality of hose attachments for vacuuming.

9. The upright vacuum cleaner according to claim 1, wherein the housing includes a recess and said removable tube is for being disposed in said recess.

* * * * *

UNITED STATES PATENT AND TRADEMARK OFFICE

CERTIFICATE OF CORRECTION

PATENT NO. : 4,955,106

DATED : September 11, 1990

INVENTOR(S) : Klaus STEIN and Heinz KAULIG

It is certified that error appears in the above-identified patent and that said Letters Patent is hereby corrected as shown below:

In column 2, line 22, after 'suction', please delete ":".

In column 5, line 13, after 'adjustment', please insert --.--.

In column 6, line 17, after '21'',', please delete "2''." and insert --22''.--.

Signed and Sealed this

Fourteenth Day of January, 1992

*Attest:*

HARRY F. MANBECK, JR.

*Attesting Officer*

*Commissioner of Patents and Trademarks*